United States Patent [19]

LeBlanc

[11] 4,023,313

[45] May 17, 1977

[54] ROTARY SANDING AND STRIPPING BLADE

[76] Inventor: Lawrence LeBlanc, 204 Leslie St., Houma, La. 70360

[22] Filed: Aug. 1, 1975

[21] Appl. No.: 601,170

[52] U.S. Cl. ..... 51/209 R; 29/78

[51] Int. Cl.[2] ..... B24D 7/02; B24D 7/18

[58] Field of Search ..... 29/78; 51/204, 209 R, 51/209 S, 395

[56] References Cited

UNITED STATES PATENTS

| | | | |
|---|---|---|---|
| 416,462 | 12/1889 | Klar | 51/209 R |
| 1,466,391 | 8/1923 | Eskew | 29/78 |
| 1,854,508 | 4/1932 | Drake | 51/209 S |
| 2,270,691 | 1/1942 | Schneider | 51/209 R |
| 2,820,746 | 1/1958 | Keeleric | 51/209 S |

*Primary Examiner*—Gary L. Smith
*Attorney, Agent, or Firm*—Fleit & Jacobson

[57] ABSTRACT

There is disclosed an elongated abrasive blade for use on a rotary device and especially suited for removing material from a surface such as a floor. The blade is essentially rectangular in shape and comprises a multiplicity of abrading chips arranged in linear groupings on a working surface of the blade. The groupings are spaced from one another, and are aligned in rows generally parallel to the major axis of the blade.

9 Claims, 2 Drawing Figures

ROTARY SANDING AND STRIPPING BLADE

BACKGROUND OF THE INVENTION

The present invention relates to blades for rotary abrading tools and the manufacture thereof. More particularly, the invention relates to an elongated blade especially suited for preparing floors and the like, and capable of rapidly removing residue glued down rubber backing from carpets adhering to a floor. Abrading tools used in the removal of material such as glued down rubber sponge from a floor after a rubber backed carpet has been removed are known to utilize abrading blades which execute a rotary motion during the abrading process. The present invention is directed to a more efficient blade which can be used in connection with such rotary motion devices.

Sandpaper is commonly utilized to prepare floors. However, sandpaper is relatively short-lived, with the result that two or three discs of regular sandpaper are required to sand down an ordinary house. In addition to being short-lived, sanding operations using sandpaper tend to be extremely time consuming, often requiring several days to complete a single job.

An alternative type of surface finishing device is disclosed in U.S. Pat. No. 2,906,612, issued to Anthony et al. In one embodiment, the Anthony et al. device utilizes a disc-like blade having a multiplicity of abrasive elements distributed on a work surface. The abrasive elements are positioned in an open distribution pattern, relatively widely spaced so as to cover only a fractional portion of the work surface. While the blade of Anthony et al. has the advantage of long life when compared with conventional sandpaper, several drawbacks still remain. The relatively uniform pattern of abrasive elements hinders the operation of the blade by shortening its life, reducing its effective cutting power, and increasing its cost. Furthermore, the disc shape hinders displacement of removed material away from the abrading machine, and material remaining near the machine has a tendency to clog the machine and reduce efficiency. The disc shape of the Anthony et al. blade also has the disadvantage in that damage to the surface being worked or surrounded surfaces often results.

It is toward the elimination of the above drawbacks of prior art devices that the present invention is directed.

SUMMARY OF THE INVENTION

The present invention relates generally to a blade used to strip material such as glued down rubber backed carpet from a surface such as a floor. The blade is rectangular and has a plurality of cutting elements attached thereto and arranged to form spaced apart groupings on the working surface. The groupings are oriented to be essentially parallel to the longitudinal centerline of the blade and are spaced from one another to permit the material removed by the blade to easily flow away from the work area. The cutting elements are preferably tungsten carbide and are made integral with the working surface of the blade by a brazing, welding or sweating process.

The spaced groupings of the cutting elements allows the blade to produce a maximum amount of cutting power with the least number of cutting elements. This arrangement also results in a low cost and a long life for the blade. Furthermore, by providing an escape path for the stripped material, the material does not interfere with the abrading operation, and hence the machine is protected from one source of overheating.

The elongated shape of the blade allows the device embodying the present invention to tear as well as to chop material adhering to a floor, thus accomplishing two functions in one operation. Furthermore, the elongated shape of the blade permits a machine operator to more easily maneuver the machine to prevent damage to the surface being abraded or to surrounding surfaces, such as walls or the like.

Using the blade embodying this invention, work which has heretofore required 8 man-days to complete has been performed in 1 man-hour. Furthermore, in use in house-floor abrading operations, a single blade has lasted 6 to 8 months. This lifetime is compared to the above-mentioned sandpaper lifetime of two or three discs per house.

The blade of the present invention is preferably made of deck plate because of the ribbing on the backside (i.e., that side opposite the working surface). This ribbing on the blade surface opposite from the abrasive surface adds strength to the blade, prevents warping during blade manufacture, and aids in heat dissipation.

It is therefore a primary object of the present invention to provide an efficient blade for use on a rotary motion device.

It is a further object of the present invention to provide a blade for rotary motion abrading devices having a long life.

Another object of the present invention is to provide an abrading blade which displaces material away from the abrading machine during a stripping operation.

It is still another object of the present invention to provide a blade which tears as well as chops material during a stripping operation.

A further object of the present invention is to provide a stripping blade which can be easily maneuvered to prevent damage to surfaces surrounding the surface being abraded.

It is yet another object of the present invention to provide a blade for quickly stripping a floor of glued down rubber backing left after the removal of a carpet.

Other objects of the present invention are to provide an abrading blade offering an extended lifetime, efficient operation and low cost.

These and other objects of the present invention, as well as many of the attendant advantages thereof, will become more readily apparent when reference is made to the following description taken in conjunction with the accompanying drawings.

DETAILED DESCRIPTION OF THE DRAWINGS

Figure 1:
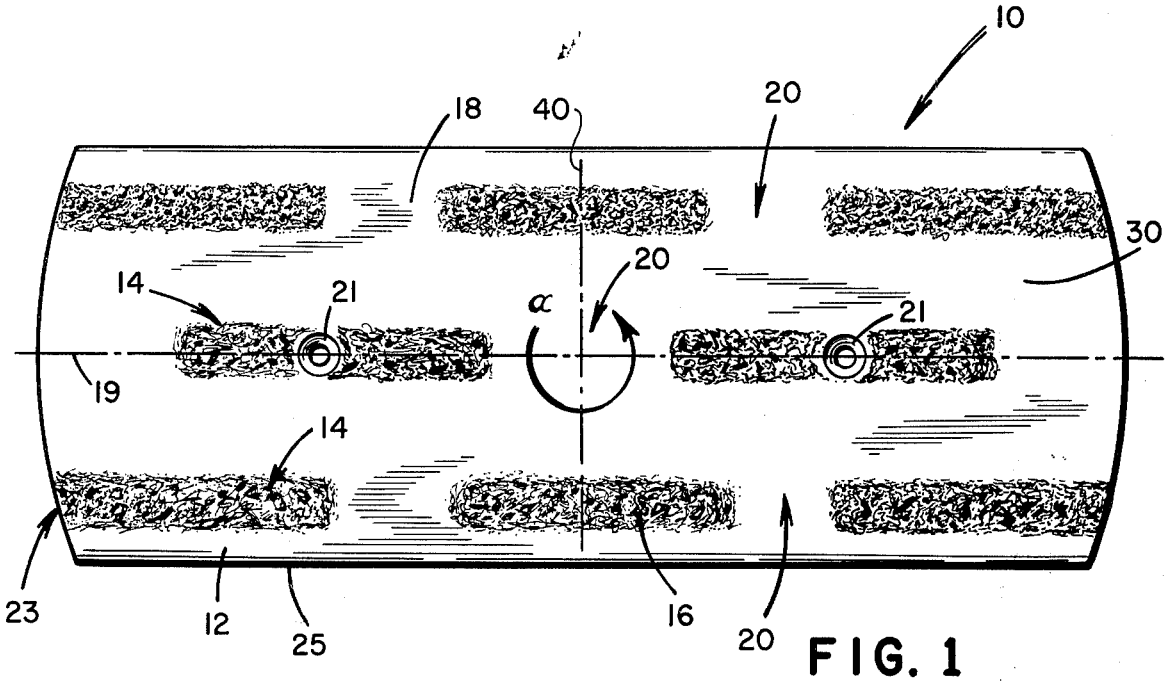
FIG. 1 shows a plan view of the working surface of a blade embodying the present invention.

Shown in FIG. 1 is a sanding and stripping blade 10 for use with a rotary abrading machine. The blade comprises an elongated body 12 and spaced apart strips 14 of abrasive materials, such as tungsten carbide chips 16 of varying sizes. The blade is rectangular in shape and the strips 14 are longitudinally positioned on the surface 18 of the blade body. The abrasive strips 14 are essentially parallel to the major axis body centerline 19 and are spaced from adjacent strips as shown at 20.

These strips 14 are arranged in rows which are themselves spaced apart along the minor axis 40 as illustrated at 30. And as best seen in FIG. 1, the strips 14 are positioned so as to be essentially perpendicular to the minor axis 40 of the blade 10. Countersunk holes 21 are provided, preferably along the blade centerline, for receiving mounting screws which attach the blade 10 to the rotary machine (not shown).

Figure 2:
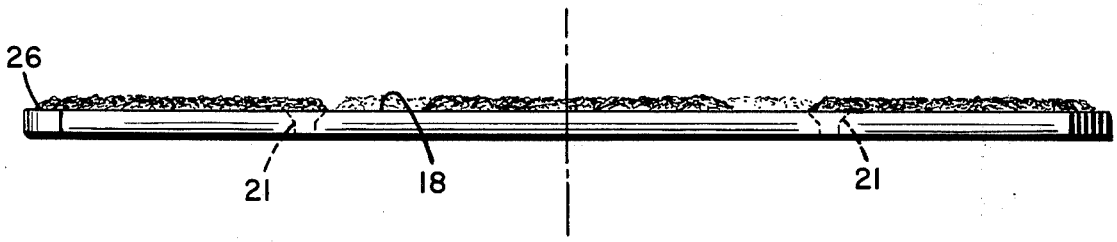
FIG. 2 shows a side view of the blade illustrated in FIG. 1.

The preferred embodiment of the invention comprises a rectangular blade 14½ inches long by 5½ inches wide and ⅜ inch thick having ¼ inch countersunk holes on the centerline 19. Chips 16 are adhered to surface 18 and form rectangular strips which are 3½ inches long by ½ inch wide. The strips forming outer rows 23 are offset ½ inch from the blade longitudinal edges 25 and as shown in FIG. 2, the strips 14 extend from the blade surface by approximately ⅛ inch, as shown at 26. The tungsten carbide chips are preferably selected from the combination shown in Table I:

TABLE I

| | | | | | | | |
|---|---|---|---|---|---|---|---|
| 30 | - | 40 | mesh (grit) | 3/16" | | | msh (grit) |
| 20 | - | 30 | | 3/16" | to | 1/4" | |
| 10 | - | 20 | | 1/4" | to | 5/16" | |
| 10 | - | 18 | | 1/4" | to | 3/8" | |
| 1/16" | to | 1/8" | | 3/8" | to | 1/2" | |
| 5/32" | | | | 1/2" | to | 5/8" | |
| 3/16" | to | 1/8" | | | | | |

Having described the blade 10, the preparation thereof will now be presented. Blade 10 is prepared by cutting and trimming a rectangular piece of metal, preferably deck plate, to the desired dimensions, drilling and countersinking holes 21, then thoroughly cleaning one surface of the metal piece. The tungsten carbide chips 16 are then applied to the surface 18 by melting nickel/silver alloy onto the surface in selected locations in order to cause the chips to adhere to the blade in the proper position to form strips 14. A heating temperature of approximately 3,000° to 4,000° F is usually required for the melting step, and it should be noted that while the heat is applied, care must be taken not to warp the blade. The chips can, of course, be affixed to the blade by other operations.

While the invention has been shown and described with reference to a preferred embodiment, other alternatives will be apparent to those skilled in the art. It is therefore the intention that the present invention not be limited by the above, but be limited only by what is recited in the appended claims.

What is claimed is:

1. A blade for a rotary motion stripping tool for removing material from a surface, the blade comprising:

a generally rectangular plate-like main body portion, one planar surface of which forms a substantially flat work surface; and means for mounting said main body portion on said stripping tool so that said main body portion rotates in the plane of its work surface;

a multiplicity of abrading elements affixed to said work surface, said abrading elements being arranged on said work surface in spaced apart strips lying substantially parallel to each other and to the major axis of said blade, and oriented so as to be essentially perpendicular to the minor axis of said blade, the length of said strips along the major axis being substantially greater than the length of said strips along the minor axis, said strips being spaced apart both along the major and minor axes of said blade, the spaces between said strips being large enough to enable the material removed from the surface being treated to be guided into said spaces and away from the stripping tool along said substantially flat work surface of said main body portion during the stripping operation.

2. The blade of claim 1, wherein said abrading elements are tungsten carbide chips.

3. The blade of claim 1, wherein said blade in on the order of about 14½ inches long and 5½ inches wide.

4. The blade of claim 3, wherein said strips are on the order of about 3½ inches long and ½ inch wide.

5. The blade of claim 1, wherein said strips extend on the order of ⅛ inch from the surface of said blade.

6. The blade of claim 1, wherein said strips are spaced apart from adjacent strips by at least about 1½ inches along the major axis of said blade.

7. The blade of claim 6, wherein said strips are spaced apart from adjacent strips by at least about 1 inch along the minor axis of said blade.

8. The blade of claim 7, wherein said blade is on the order of about 14½ inches long and 5½ inches wide.

9. The blade of claim 1, wherein said strips are spaced apart from adjacent strips by at least about 1 inch along the minor axis of said blade.

* * * * *